US007191709B2

(12) United States Patent
Nechitailo

(10) Patent No.: US 7,191,709 B2
(45) **Date of Patent: *Mar. 20, 2007**

(54) ENHANCED PERFORMANCE REACTIVE COMPOSITE PROJECTILES

(75) Inventor: Nicholas V. Nechitailo, King George, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 10 days.

This patent is subject to a terminal disclaimer.

(21) Appl. No.: 10/779,555

(22) Filed: Feb. 10, 2004

(65) Prior Publication Data

US 2005/0183618 A1 Aug. 25, 2005

(51) Int. Cl.
*F42B 12/56* (2006.01)

(52) U.S. Cl. ..... 102/518; 102/489; 102/496

(58) Field of Classification Search ..... 102/506, 102/518, 519, 520, 522, 523
See application file for complete search history.

(56) References Cited

U.S. PATENT DOCUMENTS

| | | | | | |
|---|---|---|---|---|---|
| 2,948,219 | A * | 8/1960 | Pearson et al. | ..... | 102/491 |
| 3,508,493 | A * | 4/1970 | Olenick, Jr. | ..... | 102/491 |
| 3,897,732 | A * | 8/1975 | Atkins et al. | ..... | 102/515 |
| 3,961,576 | A * | 6/1976 | Montgomery, Jr. | ..... | 102/491 |
| 4,112,846 | A * | 9/1978 | Gilbert et al. | ..... | 102/364 |
| 4,326,901 | A | 4/1982 | Leneveu et al. | ..... | 149/12 |
| 4,362,563 | A | 12/1982 | Stadler et al. | ..... | 419/5 |
| 4,503,776 | A | 3/1985 | Nussbaum et al. | ..... | 102/496 |
| 4,671,181 | A * | 6/1987 | Romer et al. | ..... | 102/518 |
| H1048 | H | 5/1992 | Wilson et al. | ..... | 102/496 |
| 5,175,392 | A * | 12/1992 | Denis | ..... | 102/364 |
| 5,198,616 | A | 3/1993 | Anderson | ..... | 102/501 |
| 5,291,833 | A * | 3/1994 | Boual | ..... | 102/506 |
| 5,313,890 | A * | 5/1994 | Cuadros | ..... | 102/496 |
| 5,374,473 | A | 12/1994 | Knox et al. | ..... | 428/218 |
| 5,445,079 | A * | 8/1995 | Boual | ..... | 102/506 |
| 5,512,624 | A | 4/1996 | Howard, Jr. et al. | ..... | 524/462 |
| 5,847,313 | A | 12/1998 | Beal | ..... | 102/516 |
| 5,852,256 | A * | 12/1998 | Hornig | ..... | 102/473 |
| 6,024,021 | A | 2/2000 | Schultz | ..... | 102/506 |
| 6,135,028 | A | 10/2000 | Kuhns et al. | ..... | 102/499 |
| 6,354,222 | B1 | 3/2002 | Becker et al. | ..... | 102/513 |
| 6,799,518 | B1 * | 10/2004 | Williams | ..... | 102/513 |
| 2003/0051629 | A1 | 3/2003 | Zavitsanos et al. | ..... | 102/510 |

* cited by examiner

*Primary Examiner*—Troy Chambers
(74) *Attorney, Agent, or Firm*—Gerhard W. Thielman Esq.; Scott R. Roalick, Esq.; Matthew J. Bussan, Esq.

(57) ABSTRACT

A reactive composite projectile includes a reactive composite material in a solid shape and an encasement material applied to and surrounding the solid shape for exerting compressive forces thereon. Additionally or alternatively, an elongate structure can be positioned in the solid shape. The elongate structure is made from a material having a mass density that is approximately 2 to 10 times the mass density of the reactive composite material.

6 Claims, 5 Drawing Sheets

FIG.1
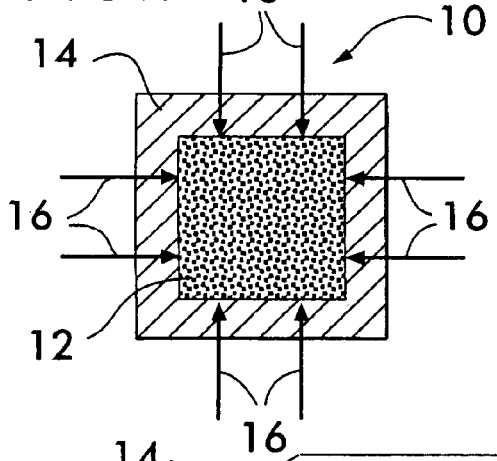
FIG.2
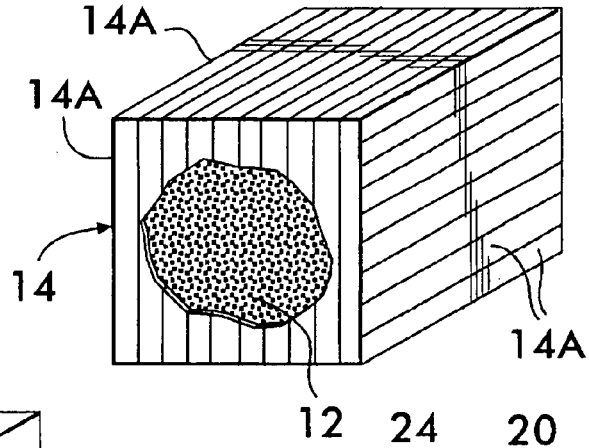
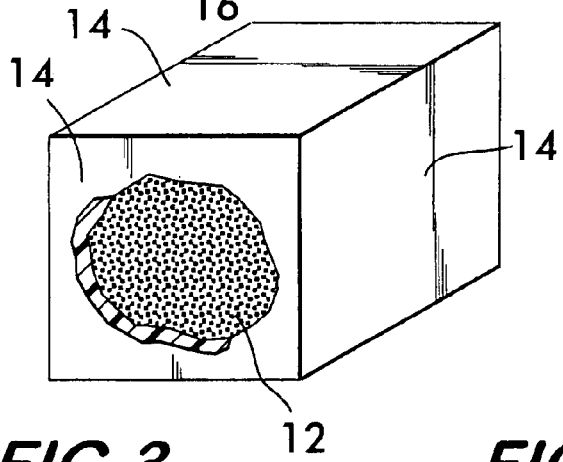
FIG.3
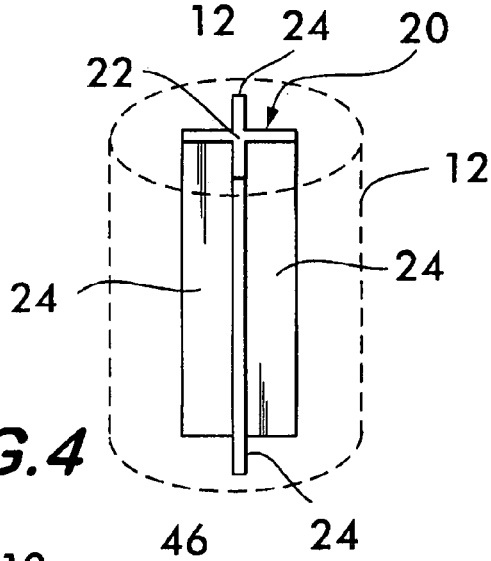
FIG.4
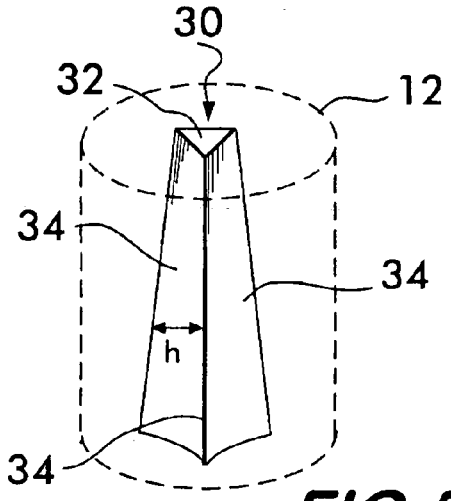
FIG.5
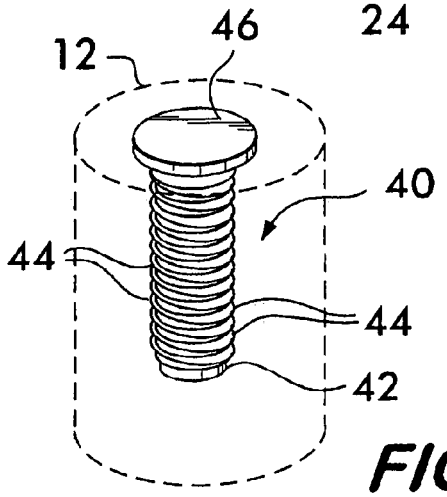
FIG.6

FIG.10
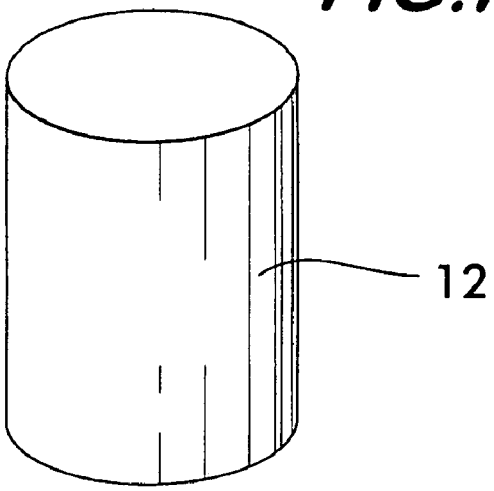
FIG.11
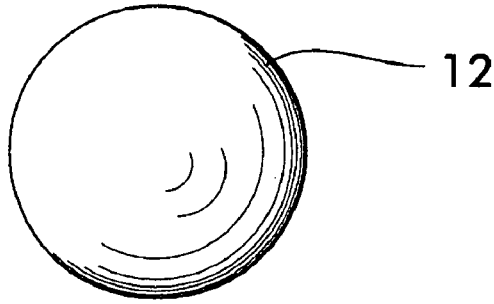
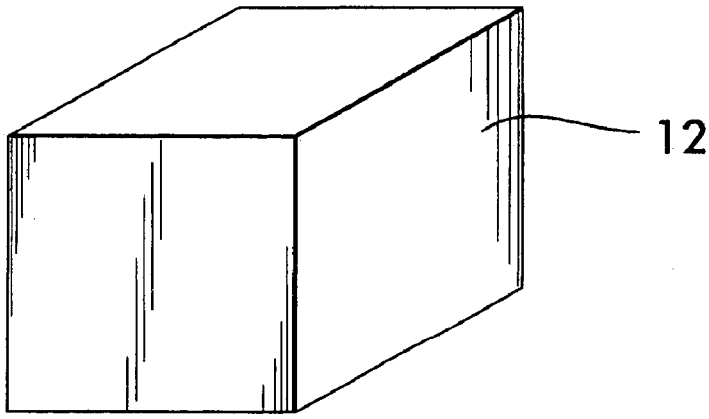
FIG.12

FIG.13
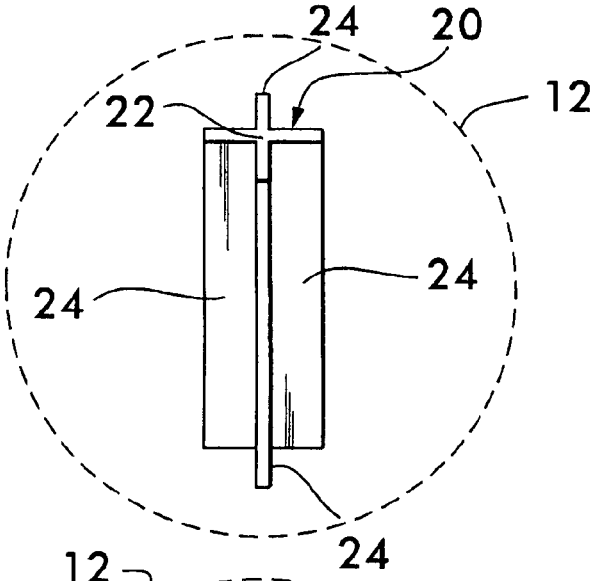
FIG.14
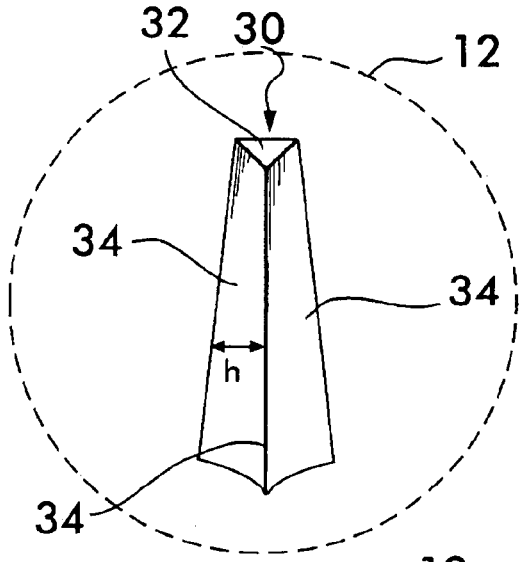
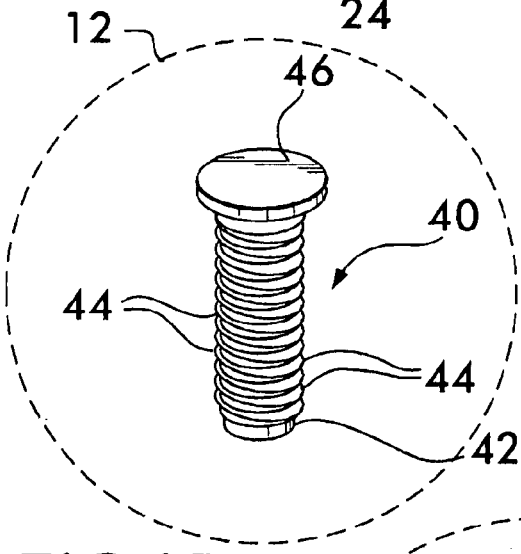
FIG.15
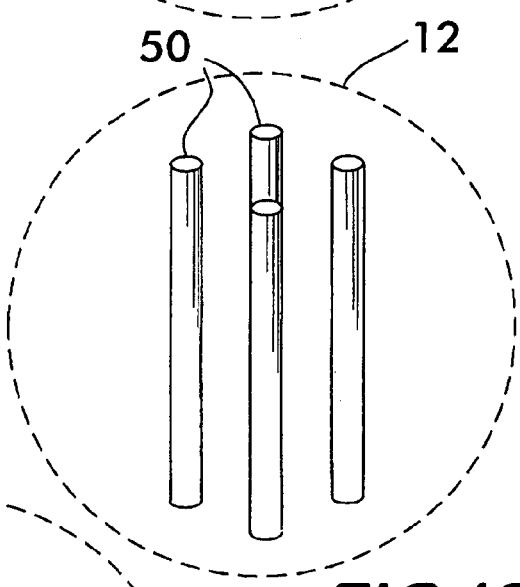
FIG.16
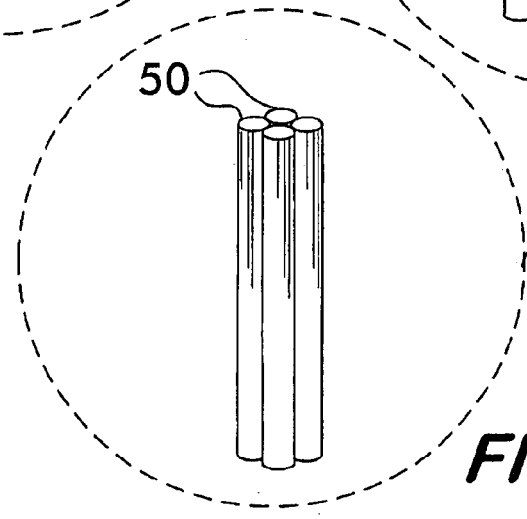
FIG.17

FIG.18
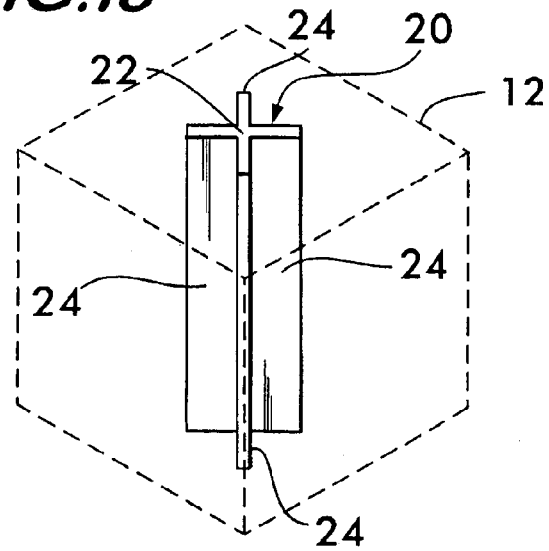
FIG.19
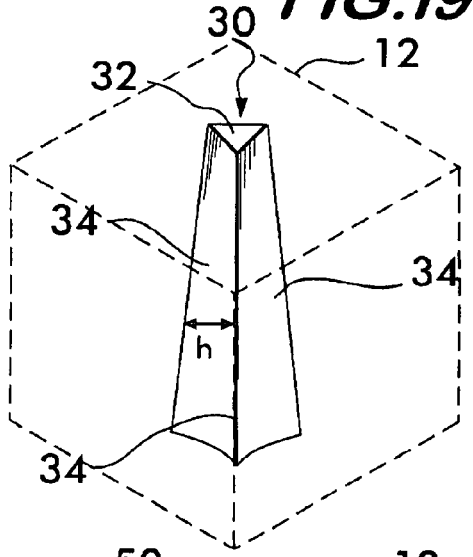
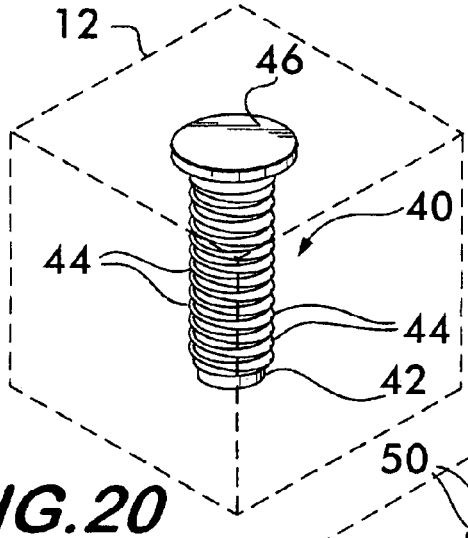
FIG.20
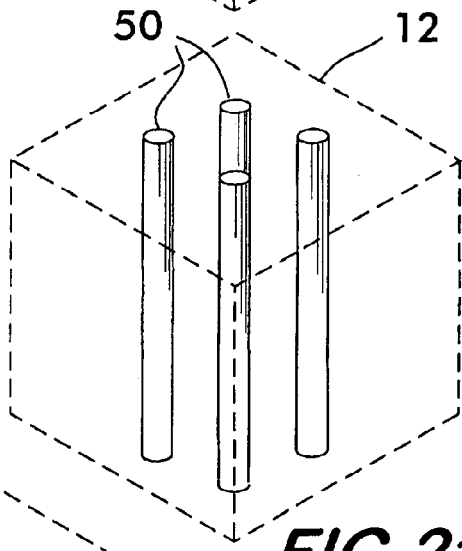
FIG.21
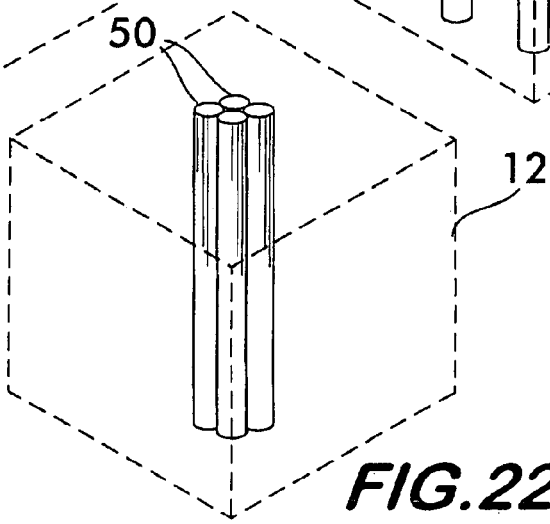
FIG.22

ENHANCED PERFORMANCE REACTIVE COMPOSITE PROJECTILES

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention relates generally to reactive materials, and more particularly to reactive material projectiles encased to enhance launch/in-flight integrity and aerodynamics, and/or having an insert that enhances performance in terms of target penetration and energy release.

BACKGROUND OF THE INVENTION

Reactive composite materials show promise for use as weapon projectiles designed to defeat a "protected" target. Such protected targets can be targets protected by a building structure or armor. Upon striking such a protected target, the energy of the impact serves as a catalyst that initiates a chemical reaction of the reactive composite material. This reaction releases a large amount of energy.

As is known in the art, reactive composite materials generally include particles or powdered forms of one or more reactive metals, one or more oxidizers, and typically some binder materials. The reactive metals can include aluminum, beryllium, hafnium, lithium, magnesium, thorium, titanium, uranium, zirconium, as well as combinations, alloys and hydrides thereof. The oxidizers can include ammonium perchlorate, chlorates, lithium perchlorate, magnesium perchlorate, peroxides, potassium perchlorate, and combinations thereof. The binder materials typically include epoxy resins and polymeric materials.

The problems associated with reactive composite projectiles are two-fold. First, the projectiles must be launched and propelled at high speeds in order to penetrate a projected target. However, reactive composite materials have relatively low mechanical strength. This limits launch and in-flight speeds for such projectiles lest they break up at launch or during flight making them aerodynamically unstable and reducing their effectiveness at target impact. Second, the relatively low strength and mass density of reactive composite projectiles limits their target penetration effectiveness on targets having thicker "skins".

SUMMARY OF THE INVENTION

Accordingly, it is an object of the present invention to enhance the performance of a reactive composite projectile in terms of launch and in-flight integrity and/or target penetration and subsequent energy release.

Other objects and advantages of the present invention will become more obvious hereinafter in the specification and drawings.

In accordance with the present invention, a reactive composite projectile includes a reactive composite material in a solid form and an encasement material applied to and surrounding the solid shape for exerting compressive forces thereon. Additionally or alternatively, an elongate structure can be positioned in the solid form. The elongate structure is made from a material having a mass density that is approximately 2 to 10 times the mass density of the reactive composite material. In general, the encasement material enhances projectile performance in terms of launch/in-flight integrity and while the elongate structure enhances projectile performance in terms of penetration/energy release.

BRIEF DESCRIPTION OF THE DRAWINGS

FIG. 1 is a cross-sectional view of a reactive composite projectile encased in a compressive material in accordance with a first aspect of the present invention;

FIG. 2 is a partial cut-away perspective view of a tape-wrapped encasing material embodiment of the reactive composite projectile of the present invention;

FIG. 3 is a partial cut-away perspective view of a shrink-cured encasing material embodiment of the reactive composite projectile of the present invention;

FIG. 4 is a perspective view of a reactive composite projectile that incorporates one embodiment of an elongate structure therein in accordance with a second aspect of the present invention;

FIG. 5 is a perspective view of a second embodiment of an elongate structure;

FIG. 6 is a perspective view of a third embodiment of an elongate structure;

FIGS. 10–12 are perspective views of solid forms for the reactive composite material and FIGS. 13–22 are perspective views of a spherical reactive composite projectile that incorporates an elongate structure; and FIGS. 18–22 are perspective views of a cubic reactive composite projectile that incorporates an elonage structure.

DETAILED DESCRIPTION OF THE INVENTION

Figure 7:
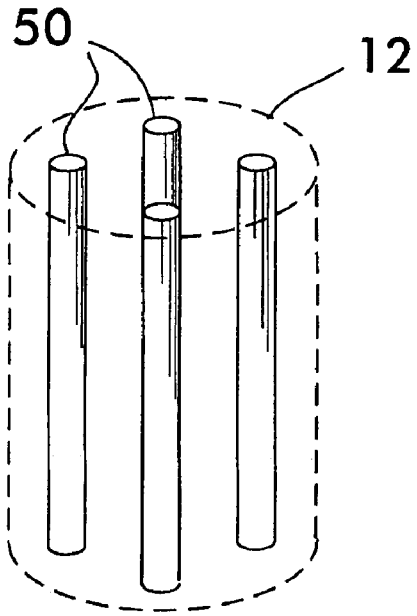
FIG. 7 is a perspective view of a fourth embodiment of an elongate structure.

Prior to describing the present invention, two terms used in the following description will first be defined. The first of these terms is "reactive composite material" and the second of these terms is "projectile". As used herein, the term "reactive composite material" refers to any composite material having constituent components that will react together to release energy when subjected to a high force of impact. As is known in the art, typical reactive composite materials include one or more metals, one or more oxidizers and binder material. The choice of reactive composite material is not a limitation of the present invention. A typical example is aluminum polytetrafluoroethylene (Al-PTFE).

The term "projectile" as used herein refers to any body that is projected or impelled forward through a medium (e.g., air). The shape of the body is not a limitation of the present invention although regular body shapes (e.g., cylinders, spheres, cubes) will typically be used. The body can be projected or launched individually or as part of a group of such bodies to include breakable arrays of interconnected projectiles. The projection force can be delivered by a mechanism (e.g., a gun, launcher, etc.) or can be delivered by explosive fragmentation of a delivery vehicle (e.g., an airborne fragmenting projectile that disperses smaller projectile bodies or fragments over an area).

The present invention can be used to enhance the performance of reactive composite projectiles in several ways. In one aspect of the present invention, launch and in-flight integrity of the projectiles is enhanced. In a second aspect of the present invention, the projectile's target penetration and subsequent energy release performance is enhanced. Further, a third aspect of the present invention combines the features of the first two aspects of the invention to improve the projectiles' launch/in-flight integrity and the projectile's penetration/energy release performance.

Referring now to the drawings, and more particularly to FIG. 1, a reactive composite projectile in accordance with a first aspect of the present invention is shown and is referenced generally by numeral 10. Projectile 10 includes a reactive composite material 12 in the form of a solid form. As mentioned above, the particular constituent elements and shape of material 12 are not limitations of the present invention. Encasing material 12 is an encasing material 14 that applies compressive forces (indicated by arrows 16) to material 12 on all sides thereof. Encasing material 14 and the resulting compressive forces 16 enhance the launch and in-flight integrity of projectile 10. Specifically, after projectile is launched or otherwise propelled through a medium such as air, material 12 is subjected to wave loading that includes waves of tension that pass through material 12. Without encasing material 14, these waves of tension would cause spalling and separation of material 12 at the edges of the shape thereof. However, the compressive state of material 12 brought about by encasing material 14 suppresses the waves of tension brought on by the launching of projectile 10. In addition, high-speed flight of an unencased material 12 can cause spalling and separation of material 12 at the outer edges thereof. However, encasing material 14 prevents such in-flight spalling and separation to insure the integrity of material 12 throughout its flight. Thus, encasing material 14 will improve the launch and in-flight integrity of reactive composite material 12.

Without encasing material 14, these waves of tension would cause spalling and separation of material 12 at the edges of the shape thereof. However, the compressive state of material 12 brought about by encasing material 14 suppresses the waves of tension brought on by the launching of projectile 10. In addition, high-speed flight of an unencased material 12 can cause spalling and separtion of material 12 at the outer edges thereof. However, encasing material 14 prevents such in-flight spalling and separation to insure the integrity of material 12 throughout its flight. Thus,encasing material 14 will improve the launch and in-flight integrity of reactive composite material 12.

A variety of materials for encasing material 14 as well as the methods of applying same to material 12 can be utilized without departing from the scope of the present invention. For example, encasing material 14 can be chosen to be either inert or reactive with material 12 when projectile 10 impacts a target. If inert with respect to material 12, encasing material 14 just provides mechanical integrity for material 12. If reactive with respect to material 12, encasing material 14 provides mechanical integrity for material 12 and can also be used to enhance and/or control the reaction of material 12 upon target impact.

Encasing material 14 can be applied to material 12 in a variety of ways provided compressive forces 16 are applied to material 12 by encasing material 14. For example, as illustrated in FIG. 2, encasing material 14 can be in the form of a tape 14A (e.g., aluminum, MYLAR, TEFLON, etc.) that is completely wrapped about material 12. Such wrapping would be accomplished by applying a tensioning force to tape 14A as it is being wrapped about material 12 so that tape 14A applies the afore-described compressive forces 16 to material 12. If encasing material 14 must present a seamless surface, material 14 can be applied to material 12 by a shrink curing process that causes compressive forces 16 to be applied as material 14 shrinks and cures. For example, encasing material 14 could be a polymeric material (e.g., polypropylene, epoxy, etc.) applied as a liquid to material 12 and then cured. Another option is for encasing material 14 to be a polymeric material (e.g., polyvinylchloride, polyethylene, polypropylene, etc.) extruded as a flexible solid about material 12 and then cured. In either case, a seamless construction of encasing material 14 results as shown in FIG. 3.

The second aspect of the present invention enhances a reactive composite projectile's target penetration and energy release performance. Several exemplary embodiments of such reactive composite projectiles will be described herein with the aid of FIGS. 4–8 where, in each of the embodiments, reactive composite material 12 is in the form of a solid cylinder that is illustrated using phantom lines. As mentioned above, it is to be understood that the cylindrical shape of material 12 is not a limitation of the present invention. FIGS. 10–12 illustrate various exemplary embodiments for the solid form, including but not limited to a cylinder, a sphere and a cube, respectively. FIGS. 13–17 illustrate various embodiments for spherical projectiles similar to the cylindrical projectiles in FIGS. 4–8. FIGS. 18–22 illustrate various embodiments for cubic projectiles similar to the cylindrical projectiles in FIGS. 4–8.

In general, each of the projectiles shown in FIGS. 4–8 have an elongate structure positioned therein that is made from a material having a mass density that is approximately 2–10 times greater than the mass density of material 12. The increased mass density improves the penetration performance of the projectile. For flight stability, the elongate structure would typically be positioned in a central portion of material 12. For applications requiring substantial penetration and energy release performance, the elongate structure is made heavier and can extend the length of material 12. For applications requiring a greater level of flight stability for the projectile, the elongate structure might extend only partially through material 12 thereby providing a weighted end. Materials used for the elongate structure can include metals such as steel, tungsten, depleted uranium or other high-mass density metals/alloys. The elongate structure could also be made from ceramics such as alumina or ceramic composites such as silicon carbide, tungsten carbide, etc. Since ceramic materials often possess greater impact strength than many metals, such ceramics may be the better choice of material where penetration performance of the projectile is of concern.

The elongate structure can be realized in a variety of ways without departing from the scope of the present invention. For example, in each of FIGS. 4–6, the elongate structure has (i) a central elongate core that extends through material 12, and (ii) fins or fin-like elements or protuberances extending radially out into material 12 from the core. More specifically, FIG. 4 illustrates an elongate structure 20 having a central core 22 with fins 24 (e.g., four are shown) aligned with core 22 and extending radially outward therefrom into material 12. More or fewer fins 24 can be used. Structure 20 can be made from a single piece of material or could be made from multiple pieces that are assembled together. Structure 20 can extend the length of material 12 (as shown) or only partially therethrough as described above.

FIG. 5 illustrates an elongate structure 30 having a central core 32 with fins 34 that are aligned with core 32 and extend radially out into material 12. The height h of each fin 34 increases along the length of material 12 such that structure 30 is tapered along its length thereby providing a greater weight at one end of the projectile.

FIG. 6 illustrates an elongate structure 40 having a central core 42 with fins 44 running helically around core 42 and extending radially outward and into material 12. Thus, structure 40 is essentially a threaded rod. Accordingly, if elongate structure 40 is a bolt, the head 46 thereof can be positioned at one end of material 12 as shown to weight the end and form an impact head for the projectile. Also note that structure 40 could be an assembly made from multiple pieces such as two elongate halves.

Figure 8:
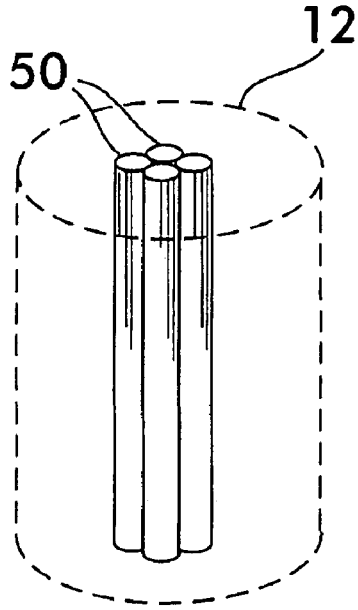
FIG. 8 is a perspective view of a fifih embodiment of an elongate structure.

The elongate structure in the present invention could also be realized by a plurality of smooth-surface or textured-surface rods 50 positioned in material 12. Rods 50 can be separated from one another as shown in FIG. 7 or could be bundled together as shown in FIG. 8. Furthermore, each of rods 50 could have elongate or helical fins extending radially outward therefrom as in each of the elongate structures depicted in FIGS. 4–6.

Each of the above-described embodiments will function in essentially the same fashion upon impact with a target. That is, upon impact, the additional mass density provided by the elongate structure enhances penetration into the target's skin. Then as the elongate structure begins to bed, buckle and/or break, the failing structure causes indentation and break up of material 12 from within. The indentations, break up and shear deformation of material 12 (from within material 12) serve as sources of chemical reaction initiation of material 12. By using fins or multiple rods, the present invention provides a large surface area of contact within material 12 to thereby reduce reaction time for material 12 which, in turn, makes for more intense shear and a more intense chemical reaction of material 12 as the elongate structure bends, buckles and/or breaks.

Figure 9:
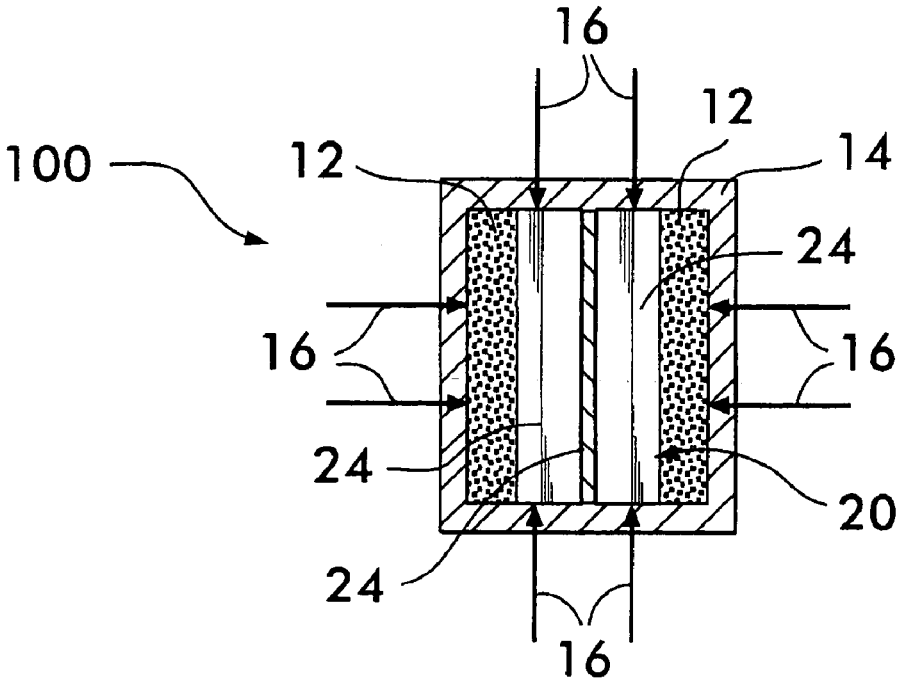
FIG. 9 is a cross-sectional view of a reactive composite projectile that is encased in a compressive material and that incorporates an elongate structure therein in accordance with a third aspect of the present invention.

The third aspect of the present invention involves combining the features of the first two aspects of the present invention. For example, FIG. 9 illustrates reactive composite projectile 100 having reactive composite material 12 that (i) is encased by encasing material 14 (to apply compressive forces 16 thereto), and (ii) has an elongate structure such as structure 20 (having fins 24) positioned therein. Thus, projectile 100 will have enhanced performance in terms of both launch/in-flight integrity/aerodynamics and penetration/energy release.

Although the invention has been described relative to a specific embodiment thereof, there are numerous variations and modifications that will be readily apparent to those skilled in the art in light of the above teachings. For example, encasement of the reactive composite material could also make use of mechanical end caps to weight the projectile for flight stability. The elongate structure positioned in the reactive composite material could combine the use of elongate fins and helical fins (or threads). It is therefore to be understood that, within the scope of the appended claims, the invention may be practiced other than as specifically described.

What is claimed as new and desired to be secured by Letters Patent of the United States is:

1. A method for enhancing launch and in-flight integrity of a reactive composite projectile, comprising the steps of:

providing a reactive composite material in a solid form, said solid form consisting of one of a sphere and a cube;

disposing an elongate structure in a central portion of said solid form, said elongate structure made from a material having a mass density that is approximately 2 to 10 times said mass density of said reactive composite material, said elongate structure having an elongate core with fin-like protuberances extending radially outward from said elongate core into said solid form; and encasing the solid form in an encasement material that applies a compressive force to the solid shape.

2. A reactive composite projectile, comprising:

a reactive composite material in a solid form, said solid form consisting of one of a sphere and a cube;

an elongate structure positioned in a central portion of said solid shape, said elongate structure made from a material having a mass density that is approximately 2 to 10 times said mass density of said reactive composite material, said elongate structure having an elongate core with fin-like protuberances extending radially outward from said elongate core into said solid form; and an encasement material applied to and surrounding said solid form for exerting compressive forces thereon.

3. A reactive composite projectile, comprising:

a reactive composite material in a solid form, said reactive composite material having a mass density, said solid form consisting of one of a sphere and a cube; and an elongate structure positioned in a central portion of said solid shape, said elongate structure made from a material having a mass density that is approximately 2 to 10 times said mass density of said reactive composite material, said elongate structure having an elongate core with fin-like protuberances extending radially outward from said elongate core into said solid form.

4. A reactive composite projectile as in claim 3 wherein said elongate structure comprises a one-piece structure.

5. A reactive composite projectile as in claim 3 wherein said fin-like protuberances extend longitudinally along said elongate core.

6. A reactive composite projectile as in claim 3 further comprising an encasement material applied to and surrounding said solid form for exerting compressive forces thereon.

* * * * *